US005653024A

United States Patent [19]

Cartagenova

[11] Patent Number: 5,653,024

[45] Date of Patent: Aug. 5, 1997

[54] CLEAN CATCH NAIL SYSTEM

[76] Inventor: Joshua Victor Cartagenova, 3901 Conshohocken Ave., Apt. 9309, Philadelphia, Pa. 19131

[21] Appl. No.: 562,708

[22] Filed: Nov. 27, 1995

[51] Int. Cl.[6] ..... A45D 29/02

[52] U.S. Cl. ..... 30/28; 132/75.5

[58] Field of Search ..... 30/28, 29; 132/73.5; D28/60

[56] References Cited

U.S. PATENT DOCUMENTS 4,776,090 10/1988 Grassi ..... 30/28

*Primary Examiner*—Douglas D. Watts

[57] ABSTRACT

A nail clipper with disposable receptacle including a conventional nail clippers having a lower jaw portion with a pair of grooves and an opening formed in an end thereof defining a lower channel. Further included is a disposable receptacle having a top opening and an outwardly extending flange formed along a periphery thereof for removably inserting within the grooves of the lower jaw portion of the nail clippers.

3 Claims, 3 Drawing Sheets

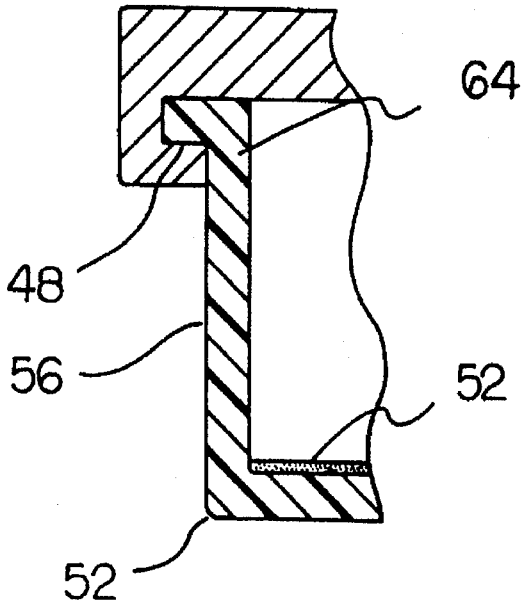
FIG. 5
FIG. 6
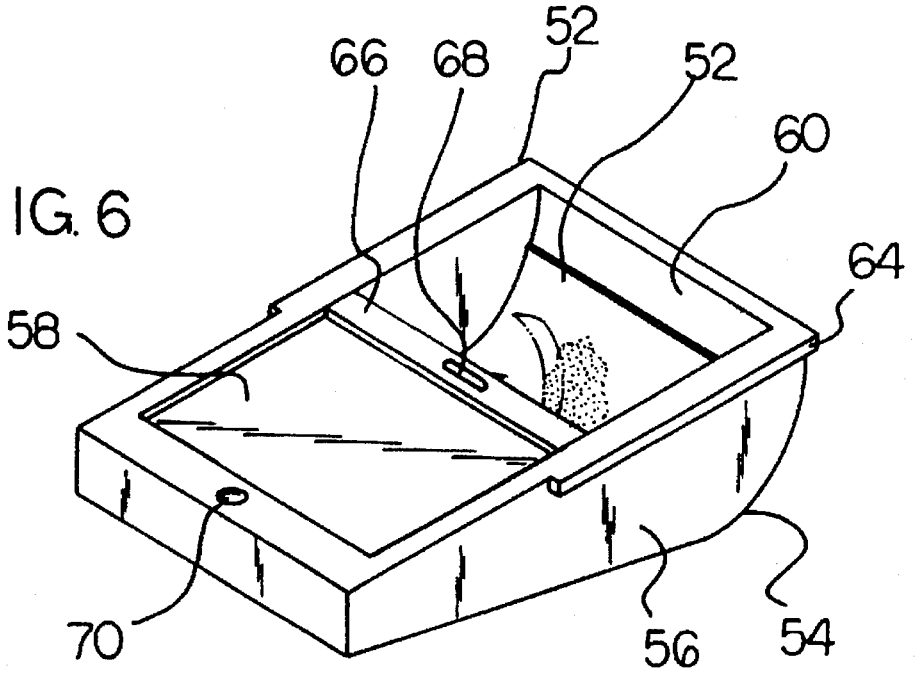

CLEAN CATCH NAIL SYSTEM

BACKGROUND OF THE INVENTION

1. Field of the Invention

The present invention relates to nail clippers with a disposable receptacle and more particularly pertains to sanitarily containing and disposing nail clippings.

2. Description of the Prior Art

The use of nail clippers is known in the prior art. More specifically, nail clippers heretofore devised and utilized for the purpose of clipping finger and toe nails are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,776,090 to Grassi discloses a nail clipper catcher, wherein a receptacle is provided for receiving clipped nails within the lower arm of a pivoting cutting member. U.S. Pat. No. 5,261,160 to Castagna discloses a nail clipper and catcher having a container within the space defined by the upper and lower cutting members. U.S. Pat. No. to 5,195,544 to Campagna discloses a nail catcher case for use with a conventional nail clipper. Lastly, U.S. Pat. No. 4,602,430 to Allen, Jr.; U.S. Pat. No. 4,062,109 to Min; and U.S. Pat. Des. 283,452 to Boschetti are provided as being of general interest.

In this respect, the nail clippers with disposable receptacle according to the present invention substantially departs from the conventional concepts and designs of the prior art, and in so doing provides an apparatus primarily developed for the purpose of sanitarily containing and disposing nail clippings.

Therefore, it can be appreciated that there exists a continuing need for new and improved nail clippers with disposable receptacle which can be used for sanitarily containing and disposing nail clippings. In this regard, the present invention substantially fulfills this need.

SUMMARY OF THE INVENTION

In view of the foregoing disadvantages inherent in the known types of nail clippers now present in the prior art, the present invention provides an improved nail clippers with disposable receptacle. As such, the general purpose of the present invention, which will be described subsequently in greater detail, is to provide a new and improved nail clippers with disposable receptacle apparatus and method which has all the advantages of the prior art and none of the disadvantages.

To attain this, the present invention essentially comprises a conventional nail clippers having a lower jaw portion with a pair of grooves and an opening formed in an end thereof defining a lower channel. For containing nail clippings a receptacle has a top opening and an outwardly extending flange formed along a periphery thereof for removably inserting within the grooves of the lower jaw portion of the nail clippers. Also included is a handle protrusion formed on the lower jaw portion of the nail clippers in combination with a sliding cover slidably disposed over the top opening of the receptacle with a handle detent formed thereon for engaging the handle protrusion of the lower jaw portion thereby opening the cover upon inserting the receptacle and closing the cover upon removing the receptacle. A first detent is formed on the lower jaw portion of the nail clippers.

Another detent is positioned on a top portion of the receptacle for engaging the first detent of the lower jaw portion thereby securing the receptacle during use. Finally, an adhesive is included lining the interior space of the receptacle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nail clippers with disposable receptacle which has all the advantages of the prior art nail clippers and none of the disadvantages.

It is another object of the present invention to provide a new and improved nail clippers with disposable receptacle which may be easily and efficiently manufactured and marketed.

It is a further object of the present invention to provide a new and improved nail clippers with disposable receptacle which is of a durable and reliable construction.

An even further object of the present invention is to provide a new and improved nail clippers with disposable receptacle which is susceptible of a low cost of manufacture with regard to both materials and labor, and which accordingly is then susceptible of low prices of sale to the consuming public, thereby making such nail clippers economically available to the buying public.

Still yet another object of the present invention is to provide a new and improved nail clippers with disposable receptacle which provides in the apparatuses and methods of the prior art some of the advantages thereof, while simultaneously overcoming some of the disadvantages normally associated therewith.

Still another object of the present invention is to sanitarily contain and dispose of nail clippings.

Lastly, it is an object of the present invention to provide a new and improved nail clipper with disposable receptacle including a conventional nail clippers having a lower jaw portion with an opening formed in an end thereof defining a lower channel and a pair of grooves. Further included is a disposable receptacle having a top opening and an outwardly extending flange formed along a periphery thereof for removably inserting within the grooves of the lower jaw portion of the nail clippers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is front cross-sectional view taken along Line 5—5 in FIG. 1.

FIG. 6 is a perspective illustration depicting the receptacle.

Similar reference characters refer to similar parts throughout the several views of the drawings.

DESCRIPTION OF THE PREFERRED EMBODIMENT

Figure 1:
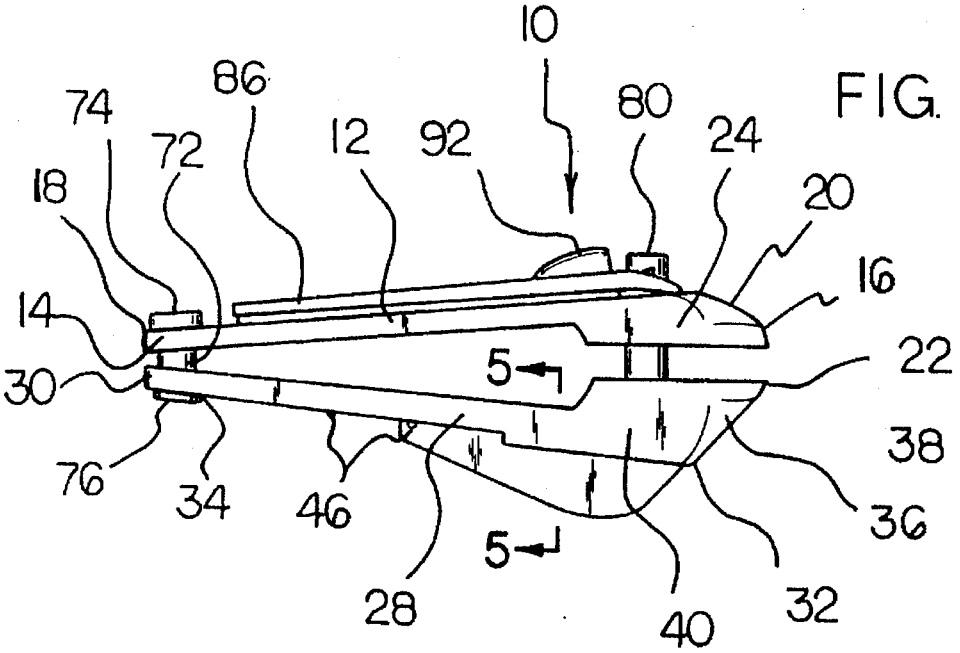
FIG. 1 is a plan illustration of the preferred embodiment of the nail clippers with disposable receptacle constructed in accordance with the principles of the present invention.
Figure 2:
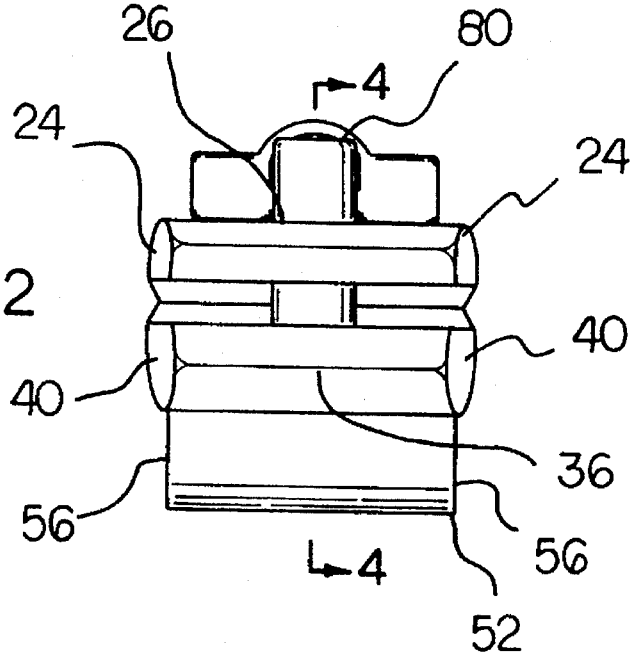
FIG. 2 is a front plan view of the present invention.
Figure 3:
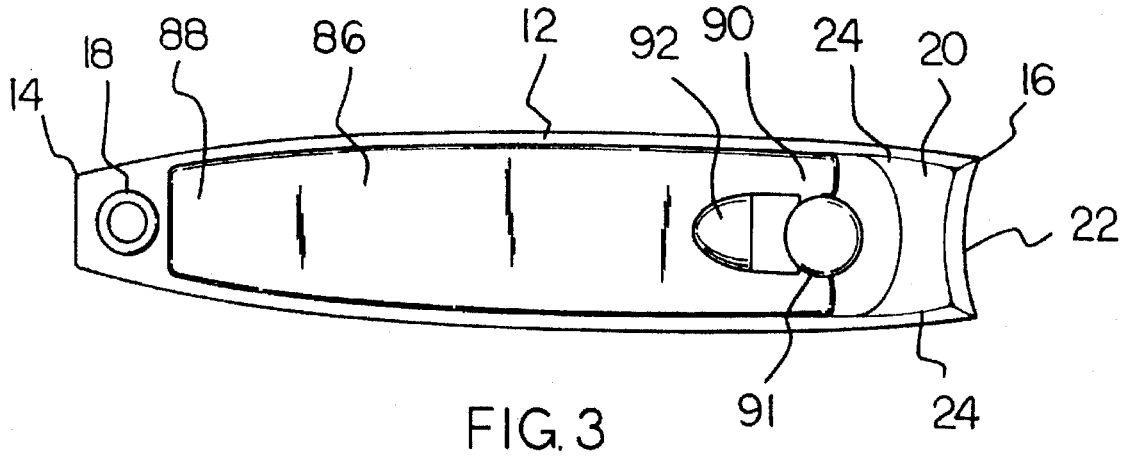
FIG. 3 is a top plan view of the present invention.
Figure 4:
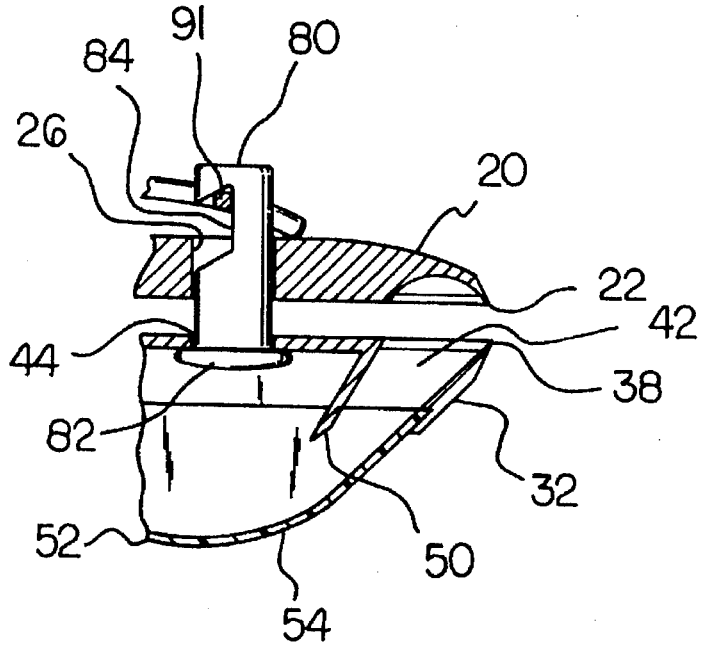
FIG. 4 is side cross-sectional view taken along Line 4—4 in FIG. 2.

With reference now to the drawings, and in particular to FIG. 1 thereof, a new and improved nail clippers with disposable receptacle embodying the principles and concepts of the present invention and generally designated by the reference numeral 10 will be described.

The present invention, the new and improved nail clippers with disposable receptacle, is comprised of a plurality of components. Such components in their broadest context include upper jaw portion, lower jaw portion, receptacle, binding post, fulcrum post, and lever. Such components are individually configured and correlated with respect to each other so as to attain the desired objective.

More specifically, it will be noted that the system 10 of present invention includes an upper planar jaw portion 12 with a fulcrum end 14 and a clipper end 16. The fulcrum end 14 has an aperture 18 dispose therein. The clipper end 16 has an arcuate downwardly extending front portion 20 with an arcuate cutting edge 22 formed thereon and pair of side walls 24 extending downwardly on opposed sides of the clipper end defining an upper compartment. The clipper end further has an aperture 26 centrally disposed therein.

Further included is a lower planar jaw portion 28 with a fulcrum end 30 and a clipper end 32. The fulcrum end 30 has an aperture 34 disposed therein. The clipper end 32 has an arcuate upwardly extending front portion 36 with an arcuate cutting edge 38 formed thereon and pair of side walls 40 on opposed sides of the clipper end with an opening 42 formed therebetween defining a lower channel. The clipper end 32 further has an aperture 44 centrally disposed therein. The lower planar jaw portion 28 has a pair of detents 46, a pair of grooves 48, and a handle protrusion 50, each extending downwardly on a lower face of the clipper end. The length of the lower jaw is approximately 3 and ½ inches and is equivalent to the length of the upper jaw.

For collecting nail clippings, a disposable nail receptacle 52 is included and has an arcuate lower wall 54 which is tapered from a front end to a rear end, a pair of side walls 56 and partial top wall 58 defining an interior space with an opening 60 at the front end thereof. The width of the nail receptacle is equivalent to the width of the planar strip member of the upper and lower jaw portions. The length of the receptacle is approximately ½ the length of the upper and lower jaw portions. The nail receptacle further has an adhesive 62 lining the interior space, an outwardly extending flange 64 formed on the front end thereof for removably inserting within the grooves of the lower jaw portion, and a sliding cover 66 slidably disposed over the opening with a handle detent 68 formed thereon for engaging the handle protrusion of the lower jaw portion thereby opening the cover upon inserting the receptacle and closing the cover upon removing the receptacle. The receptacle employs a detent 70 positioned on a rear end of the top wall for engaging the detents 46 of the lower jaw portion thereby securing the receptacle during and after use.

A fulcrum post 72 is disposed within the fulcrum aperture 18 of the upper jaw portion and fulcrum aperture 34 of the lower jaw portion with an upper flange 74 formed on an upper end and a lower flange 76 formed on a lower end. The post couples the upper jaw portion and lower jaw portion with the clipping edge of the upper portion adjacent the clipping edge of the lower portion with a space therebetween. Optionally, a file member may be pivotally coupled to the fulcrum post.

A binding post 80 is disposed within the aperture 26 disposed within the clipper end of the upper jaw portion and aperture 44 disposed within the clipper end of the lower jaw portion with a lower flange 82 formed on a lower end thereof and a indention 84 formed in a upper end thereof.

Also included is an elongated lever 86 with a planar handle end 88 and an angled lever end 90. The lever end 90 utilizes an axle 91 formed on an end thereof and a fulcrum protrusion 92 formed adjacent to the axle to allow the lever to swivel and pivot with respect to the jaw portions. As a result, the lever has a first orientation with the fulcrum protrusion abutting the upper jaw portion for forcibly clamping together the clipper edges and collecting nail clippings within the receptacle. In the first orientation, the lever has an biased mode with the handle end of the lever abutting the upper jaw portion and unbiased mode with the handle end disposed approximately 2 and ¼ inches above the upper jaw portion. The lever further has a second orientation with the fulcrum protrusion opposite the upper jaw portion for storing the nail clippers.

The present invention provides nail clippers with a disposable receptacle which offers a multitude of advancements in the art of nail clippers. The instant invention offers a convenient system of sanitarily trimming finger or toe nails. A disposable, removable receptacle is included with an adhesive lining to contain nail clippings therein while the device is in use. In addition, a slidable cover is included which incorporates a handle for engaging a handle protrusion formed on the clippers thereby opening the cover upon insertion and closing the cover upon removal. Such a feature offers a clean and controlled method of cutting nails invaluable to beauticians, families, podiatrists, manicurists, pediatricians, pedicurists, hospitals, nursing homes, and the like. The clippers may also be manufactured incorporating a black gloss finish, gold plate, bronze plate, brass plate and further including indicia depicting names, logos, and initials thus contributing to the novelty thereof. Finally, the present invention may include a plurality of disposable receptacles and a conventional carrying case.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pair of nail clippers with disposable receptacle comprising, in combination:

an upper planar jaw portion with a fulcrum end and a clipper end, the fulcrum end having an aperture dispose therein, the clipper end having an arcuate downwardly extending front portion with an arcuate cutting edge formed thereon and pair of side walls extending downwardly on opposed sides of the clipper end defining an upper compartment, the clipper end further having an aperture centrally disposed therein;

a lower planar jaw portion with a fulcrum end and a clipper end; the fulcrum end having an aperture dispose therein; the clipper end having an arcuate upwardly extending front portion with an arcuate cutting edge formed thereon and pair of side walls on opposed sides of the clipper end with an opening formed therebetween defining a lower channel; the clipper end further having an aperture centrally disposed therein; the lower planar jaw portion having a pair of detents, a pair of grooves, and a handle protrusion; the detents, grooves, and handle protrusion extending downwardly on a lower face of the clipper end;

a disposable nail receptacle having an arcuate lower wall, a pair of side walls and partial top wall defining an interior space with an opening at a front end thereof; the nail receptacle further having an adhesive lining the interior space, an outwardly extending flange formed on the front end thereof for removably inserting within the grooves of the lower jaw portion, a sliding cover slidably disposed over the opening with a handle detent formed thereon for engaging the handle protrusion of the lower jaw portion thereby opening the cover upon inserting the receptacle and closing the cover upon removing the receptacle and a detent positioned on a rear end of the top wall for engaging the detent of the lower jaw portion thereby securing the receptacle during use;

a fulcrum post disposed within the fulcrum aperture of the upper jaw portion and fulcrum aperture of the lower jaw portion with an upper flange formed on an upper end and a lower flange formed on a lower end coupling the upper jaw portion and lower jaw portion with the clipping edge of the upper portion adjacent the clipping edge of the lower portion with a space therebetween;

a binding post disposed within the aperture situated within the clipper end of the upper jaw portion and aperture situated within the clipper end of the lower jaw portion with an lower flange formed on a lower end thereof and a indention formed in a upper end thereof; and an elongated lever with a planar handle end and an angled lever end, the lever end having an axle formed on an end thereof and a fulcrum protrusion formed adjacent the axle, the lever adapted to swivel and pivot with respect to the jaw portions, the lever having a first orientation with the fulcrum protrusion abutting the upper jaw portion for forcibly clamping together the clipper edges and collecting nail clippings within the receptacle, the lever further having a second orientation with the fulcrum protrusion opposite the upper jaw portion for storing the nail clippers.

2. A pair of nail clippers with disposable receptacle comprising:

nail clippers having a lower jaw portion with an opening formed in an end thereof defining a lower channel and a pair of grooves;

a receptacle having a top opening and an outwardly extending flange formed along a periphery thereof for removably inserting within the grooves of the lower jaw portion of the nail clippers, the top opening having a cover removably disposed thereon;

a handle protrusion formed on the lower jaw portion of the nail clippers; and the cover slidably disposed over the top opening of the receptacle with a handle detent formed thereon for engaging the handle protrusion of the lower law portion thereby opening the cover upon inserting the receptacle and closing the cover upon removing the receptacle.

3. A pair of nail clippers with disposable receptacle comprising:

nail clippers having a lower jaw portion with an opening formed in an end thereof defining a lower channel and a pair of grooves;

a receptacle having a top opening and an outwardly extending flange formed along a periphery thereof for removably inserting within the grooves of the lower law portion of the nail clippers, the top opening having a cover removably disposed thereon; and an adhesive lining inside the interior space of the receptacle.

* * * * *